US005629656A

United States Patent [19]

Tada et al.

[11] Patent Number: 5,629,656

[45] Date of Patent: May 13, 1997

[54] DIELECTRIC RESONATOR APPARATUS COMPRISING CONNECTION CONDUCTORS EXTENDING BETWEEN RESONATORS AND EXTERNAL SURFACES

[75] Inventors: Hitoshi Tada, Ishikawa-ken; Hideyuki Kato; Tatsuya Tsujiguchi, both of Kanazawa, all of Japan

[73] Assignee: Murata Manufacturing Co., Ltd., Japan

[21] Appl. No.: 317,334

[22] Filed: Oct. 4, 1994

[30] Foreign Application Priority Data

Oct. 6, 1993 [JP] Japan ..... 5-250669

[51] Int. Cl.[6] ..... H01P 1/205

[52] U.S. Cl. ..... 333/202; 333/206

[58] Field of Search ..... 333/202, 203, 333/206, 222, 202 DB

[56] References Cited

U.S. PATENT DOCUMENTS

| | | | |
|---|---|---|---|
| 4,523,162 | 6/1985 | Johnson | 333/202 |
| 5,010,309 | 4/1991 | Manssen et al. | 333/202 X |
| 5,130,683 | 7/1992 | Agahi-Kesheh et al. | 333/203 |
| 5,162,760 | 11/1992 | Phillips et al. | 333/206 |
| 5,191,305 | 3/1993 | Frost et al. | 333/202 |

FOREIGN PATENT DOCUMENTS

| | | | |
|---|---|---|---|
| 90203 | 4/1988 | Japan | 333/202 DB |
| 173902 | 7/1989 | Japan | 333/202 DB |
| 4150101 | 5/1992 | Japan | 333/222 |
| 5183309 | 7/1993 | Japan . | |
| 5199011 | 8/1993 | Japan . | |

*Primary Examiner*—Benny Lee

*Attorney, Agent, or Firm*—Ostrolenk, Faber, Gerb & Soffen, LLP

[57] ABSTRACT

A dielectric resonator apparatus includes at least one dielectric coaxial resonator in a dielectric block of a dielectric material having first and second end surfaces, and a plurality of side surfaces. At least one cylindrical resonator hole is disposed so as to penetrate the dielectric block and an outer conductor is disposed on at least the first end surface and, the plurality of side surfaces. Further, at least one inner conductor is disposed in the resonator hole so that one end thereof located on the first end surface side is electrically insulated from the outer conductor, thereby constituting at least one dielectric coaxial resonator. A pair of input and output electrodes is disposed on at least one predetermined side surface of the dielectric block so as to be electrically insulated from the outer conductor and to be close to one end of the inner conductor located adjacent the first end surface. Furthermore, two penetrating holes are disposed so as to penetrate the dielectric block between a pair of input and output electrodes and the inner conductor, and two connection conductors for electrically connecting a pair of input and output electrodes to the inner conductor are disposed in the penetrating holes.

13 Claims, 7 Drawing Sheets

DIELECTRIC RESONATOR APPARATUS COMPRISING CONNECTION CONDUCTORS EXTENDING BETWEEN RESONATORS AND EXTERNAL SURFACES

BACKGROUND OF THE INVENTION

1. Field of the Invention

The present invention relates to a dielectric resonator apparatus, and in particular, to a dielectric resonator apparatus comprising at least one dielectric resonator coaxial resonator and having connection conductors for external couplings, wherein the dielectric resonator apparatus is preferably used as a dielectric filter.

2. Description of the Prior Art

FIG. 4A is a perspective view of an appearance of a conventional comb-line type dielectric resonator apparatus having a rectangular-parallelepiped-shaped dielectric block 1, FIG. 4B is a cross-sectional view along a line IVB—IVB' of FIG. 4A, and FIG. 4C is a cross-sectional view along a line IVC—IVC' of FIG. 4A.

Referring to FIGS. 4A, 4B and 4C, three circular cylindrical resonator holes 2*a*, 2*b* and 2*c* are arranged in parallel to each other in the dielectric block 1 so as to penetrate the dielectric block 1 between a pair of first end second end surfaces which are disposed oppose to each other, so that each of the resonator holes 2*a* to 2*c* has an opening on the first end surface 1*a*, and has another opening on the second end surface 1*b* as seen in FIG. 4C. Further, an outer electric conductor 5 is formed on all the surfaces of the dielectric block 1 as seen in FIG. 4A. In the specification, an electric conductor is referred to as a conductor hereinafter. Inner conductors 3*a*, 3*b* and 3*c* shown in FIGS. 4A and 4B are formed respectively on the inner peripheral surfaces of the resonator holes 2*a*, 2*b* and 2*c*, so that a conductor-non-formed portion or gap 30 shown in FIG. 4C, where each of the inner conductors 3*a* to 3*c* is not formed, is formed in the vicinity of the first end surface 1*a* and also another end of each of the inner conductors 3*a* to 3*c* located on the side of the second end surface 1*b* is electrically connected to the outer conductor 5, as shown in FIG. 4C. The longitudinal length of each of the inner conductors 3*a* to 3*c* is set to a quarter of the guide-wavelength $\lambda g/4$. Furthermore, a pair of input and output electrodes 14*a* and 14*b* shown in FIG. 4A is formed respectively on a predetermined side surface 1*c* of the dielectric block 1 so as to be electrically insulated from the outer conductor 5 and so as to be close to one ends of the inner conductors 3*a* and 3*c* located in the side of the second end surface 1*b* of the dielectric block 1.

In the conventional dielectric resonator apparatus having such a structure, three quarter-wavelength dielectric coaxial resonators are constituted corresponding to the inner conductors 3*a* to 3*c*, and as shown in FIGS. 4B and 4C, an external coupling capacitance Ce shown in FIG. 4B and 4C is formed between the input electrode 14*a* and the inner conductor 3*a*, and another external coupling capacitance Ce shown in FIG. 4B is formed between the output electrode 14*b* and the inner conductor 3*c*. In the conventional dielectric resonator apparatus, the above-mentioned external coupling capacitances Ce can be changed by adjusting the areas of a pair of input and output electrodes 14*a* and 14*b*, or by adjusting the distance between the input electrode 14*a* and the inner conductor 3*a* and the distance between the output electrode 14*b* and the inner conductor 3*b*.

In the case where the above-mentioned external coupling capacitances Ce are changed by adjusting the areas of a pair of input and output electrodes 14*a* and 14*b*, when the external coupling capacitances Ce are increased by increasing the areas of a pair of input and output electrodes 14*a* and 14*b*, this results in a decrease in the unloaded Q ($Q_o$) of the conventional dielectric resonator apparatus.

On the other hand, in the case where the above-mentioned external coupling capacitances Ce are changed by adjusting the distance between the input electrode 14*a* and the inner conductor 3*a* and the distance between the output electrode 14*b* and the inner conductor 3*b*, it is necessary change the sizes of the dielectric resonator apparatus such as the sizes of the dielectric block 1, the sizes of the resonator holes 2*a* to 2*c* or the like.

Accordingly, it is difficult to obtain a predetermined desirable optimum unloaded Q ($Q_o$) in the electric characteristics of the conventional dielectric resonator apparatus. On the other hand, in order to manufacture various kinds of dielectric resonator apparatuses having various kinds of electric characteristics, it is necessary to manufacture many dielectric resonator apparatuses having different sizes corresponding to the respective electric characteristics. This results in increase in the manufacturing cost and the managing cost.

Further, when the external coupling capacitances Ce are increased by increasing the inner diameters of the resonator holes 2*a* to 2*c*, the mechanical strength of the dielectric block 1 decreases.

SUMMARY OF THE INVENTION

One object of the preferred embodiments of the present invention is therefore to provide a dielectric resonator apparatus comprising at least one dielectric coaxial resonator, capable of easily obtaining predetermined desirable optimum external couplings without changing the sizes of the dielectric resonator apparatus and without decreasing the unloaded Q ($Q_o$).

In order to achieve the aforementioned objective, according to one aspect of the preferred embodiments of the present invention, there is provided a dielectric resonator apparatus comprising:

a dielectric block of a dielectric material having first and second end surfaces, and a plurality of side surfaces located between the first end surface and the second end surface;

at least one cylindrical resonator hole formed so as to penetrate an inner portion of said dielectric block, the resonator hole having opening on the first end surface of the dielectric block and another opening on the second end surface of the dielectric block;

an outer conductor formed on at least the first end surface and the plurality of side surfaces of the dielectric block;

at least one inner conductor formed on an inner portion of the resonator hole so that one end thereof located on the side of the first end surface of the dielectric block is electrically connected to the outer conductor and another end thereof located on the side of second end surface of the dielectric block is electrically insulated from the outer conductor, thereby constituting at least one dielectric coaxial resonator;

a pair of input and output electrodes formed on at least one predetermined side surface of the dielectric block so as to be electrically insulated from the outer conductor and so as to be close to one end of the inner conductor located on the side of the first end surface of the dielectric block;

two penetrating holes formed so as to penetrate an inner portion of the dielectric block between the pair of input and output electrodes and the inner conductor, respectively; and two connection conductors for electrically connecting the pair of input and output electrodes to the inner conductor, respectively, the two connection conductors being formed on inner portions of the penetrating holes.

In the above-mentioned dielectric resonator apparatus, the pair of input and output electrodes is preferably formed so as to extend from the predetermined side surface of the dielectric block to the first end surface thereof.

In the above-mentioned dielectric resonator apparatus, the two penetrating holes are preferably formed so as to penetrate the inner portion of the dielectric block between the first end surface of the dielectric block to the inner conductor.

In the above-mentioned dielectric resonator apparatus, the pair of input and output electrodes is preferably formed so as to extend from the predetermined side surface of the dielectric block to the other side surfaces thereof, respectively.

In the above-mentioned dielectric resonator apparatus, the two penetrating holes are preferably formed so as to penetrate the inner portion of the dielectric block between the predetermined side surface of the dielectric block to the inner conductor.

In the above-mentioned dielectric resonator apparatus, the apparatus preferably comprises a plurality of resonator holes and a plurality of inner conductors, thereby comprising a plurality of dielectric coaxial resonators, the pair of input and output electrodes is formed so as to be close to said two inner conductors located at both ends of the plurality of inner conductors, respectively, the two penetrating holes are formed so as to penetrate the inner portion of the dielectric block between the pair of input and output electrodes and the two inner conductors located at both ends of the plurality of inner conductors, respectively, and the two connection conductors electrically connect the pair of input and output electrodes to said two inner conductors located at both ends of the plurality of inner conductors, respectively.

According to the preferred embodiments of the present invention, predetermined desirable optimum external couplings can be obtained without changing the sizes of the dielectric resonator apparatus and without lowering the unloaded Q ($Q_0$) thereof by changing in a direction substantially parallel to the axes of the resonator hole, the forming positions of the connection conductors for electrically connecting a pair of input and output electrodes with the inner conductor corresponding thereto or the forming positions of the penetrating holes. Accordingly, the dielectric block can be used in common with a plurality of dielectric resonator apparatuses, and can be standardized, resulting in decrease in the manufacturing cost and the managing cost. Then the inexpensive dielectric resonator apparatus having a higher unloaded Q ($Q_0$) and predetermined desirable optimum external couplings can be obtained.

BRIEF DESCRIPTION OF THE DRAWINGS

These and other objects and features of the preferred embodiments of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1A:
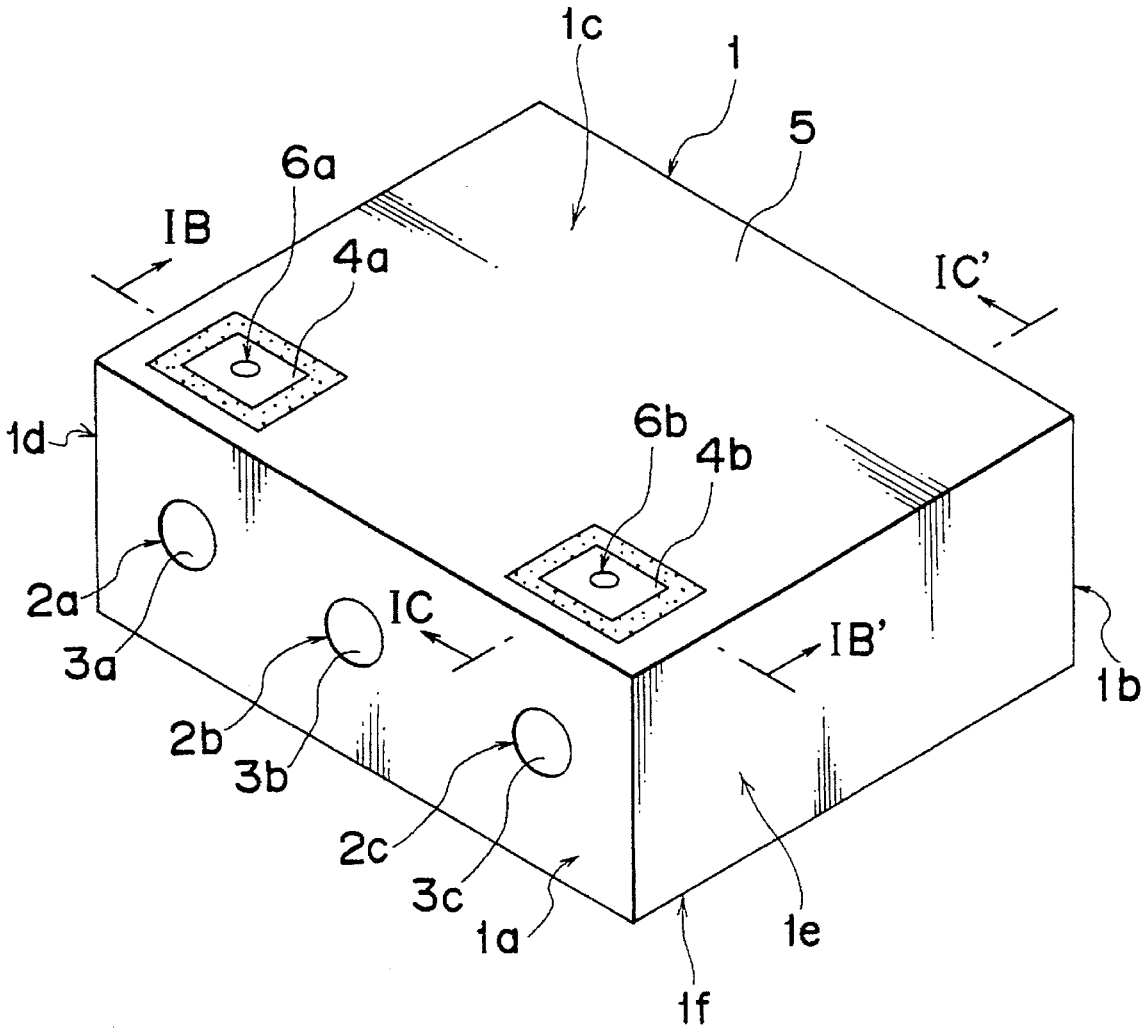
FIG. 1A is a perspective view of an appearance of a comb-line type dielectric resonator apparatus according to a first preferred embodiment of the present invention.

The preferred embodiments according to the present invention will be described below with reference to the attached drawings where like parts in different drawings are designated by like reference numerals which may be described in detail in some of the drawings.

FIRST PREFERRED EMBODIMENT

Figure 1B:
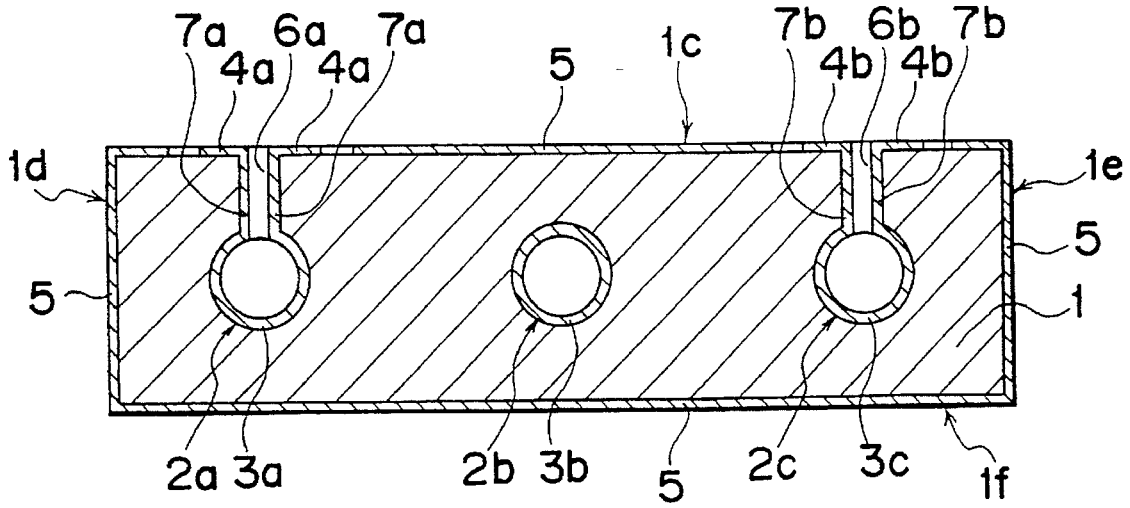
FIG. 1B is a cross-sectional view along a line IB—IB' of FIG. 1A.
Figure 1C:
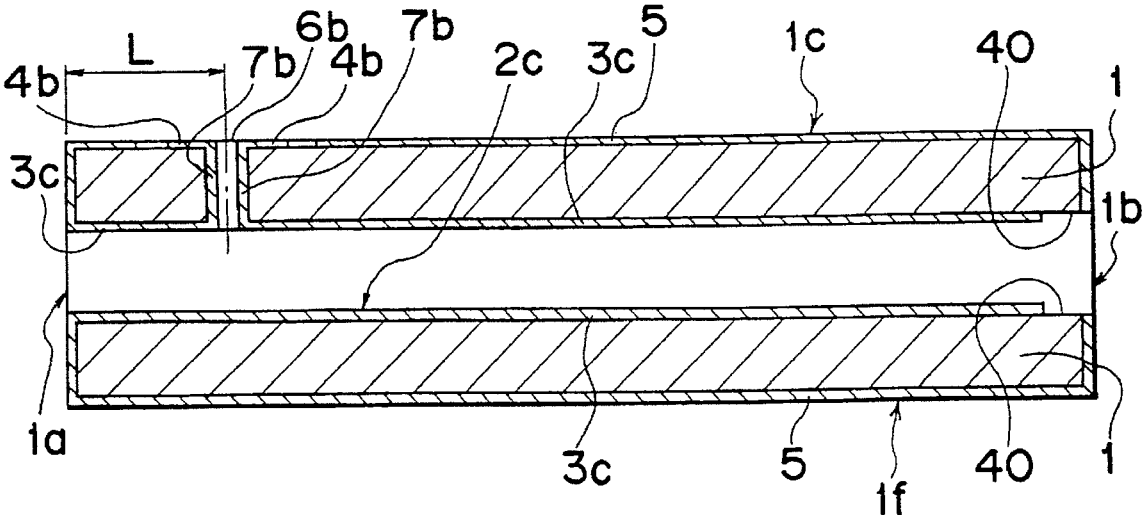
FIG. 1C is a cross-sectional view along a line IC—IC' of FIG. 1A.

FIG. 1A is a perspective view of an appearance of a comb-line type dielectric resonator apparatus according to a first preferred embodiment of the present invention, FIG. 1B is a cross-sectional view along a line IB—IB' of FIG. 1A, and FIG. 1C is a cross-sectional view along a line IC—IC' of FIG. 1A.

Referring to FIGS. 1A, 1B and 1C, the dielectric resonator apparatus comprises a substantially rectangular-parallelepiped-shaped dielectric block 1 having first and second end surfaces 1*a* and 1*b*, and four side surfaces 1*c*, 1*d*, 1*e* and if located between the first and second surfaces 1*a* and wherein the first and second end surfaces 1*a* and 1*b* are disposed to each other, the side surfaces 1*c* and 1*f* are disposed opposite to each other, and the side surfaces 1*d* and 1*e* are disposed opposite to each other. Three circular cylindrical resonator holes 2*a*, 2*b* and 2*c* are formed substantially in parallel to each other in the dielectric block 1 so as to penetrate the dielectric block 1 between a pair of the first end second end surfaces 1*a* and 1*b* which are disposed opposite to each other, so that each of the resonator holes 2*a* to 2*c* has an opening on the first end surface 1*a*, and has another opening on the second end surface 1*b*.

Further, an outer conductor 5 is formed on all the surfaces 1*a* to 1*f* of the dielectric block 1, and inner conductors 3*a*, 3*b* and 3*c* are formed respectively on the inner peripheral surfaces of the resonator holes 2*a*, 2*b* and 2*c*, so that a conductor-non-formed portion or gap 40 (see FIG. 1C), where each of the inner conductors 3*a* to 3*c* is not formed, is formed in the vicinity of the second end surface 1*b* and also one end of each of the inner conductors 3*a* to 3*c* located on the side of the first end surface 1*a* is electrically connected to the outer conductor 5, as shown in FIG. 1C. The longitudinal length of each of the inner conductors 3*a* to 3*c* is set to a quarter of the guide-wavelength $\lambda g/4$. Accordingly, since the one ends of the inner conductors 3*a* to 3*c* located on the side of the first end surface 1*a* of the dielectric block 1 are electrically connected to the outer conductor 5, the first end surface 1*a* of the dielectric block 1 becomes a short-circuit surface. On the other hand, since the other ends of the inner conductors 3*a* to 3*c* located on the side of the second end surface 1*b* of the dielectric block 1 are electrically insulated from the outer conductor 5, the second end surface 1*b* of the dielectric block 1 becomes an open-circuit surface.

Furthermore, a pair of rectangular input and output electrodes 4*a* and 4*b* is formed respectively on the predetermined side surface 1*c* of the dielectric block 1 located between the first and second end surfaces 1*a* and 1*b* so as to be electrically insulated from the outer conductor 5 and so as to be close to one ends of the inner conductors 3*a* and 3*c* located on the side of the first end surface 1*a* of the dielectric block 1, wherein the predetermined side surface 1*c* of the dielectric block 1 is the top surface thereof shown in FIG. 1A.

As shown in FIGS. 1B and 1C, a penetrating hole 6*a* is formed so as to penetrate the dielectric block 1 between the resonator hole 2*a* and a part of the side surface 1*c* on which the input electrode 4*a* is formed, in a direction parallel to the first and second end surfaces 1*a* and 1*b* or perpendicular to the axial directions of the resonators holes 2*a* to 2*c*, and so as to be close to the first end surface 1*a*, wherein the part of the side surface 1*c* on which the input electrode 4*a* is formed is located apart from the first end surface 1*a* by a predetermined length L which is smaller than half the longitudinal length of the dielectric coaxial resonators. Further, a connection conductor 7*a* is formed on the inner peripheral surface of the penetrating hole 6*a* so that one end of the connection conductor 7*a* is electrically connected to the input electrode 4*a* and the other end of the connection electrode 7*a* is electrically connected to the inner connector 3*a*. Then, the input electrode 4*a* is electrically connected through the connection conductor 7*a* to the inner conductor 3*a*.

Furthermore, another penetrating hole 6*b* is formed so as to penetrate the dielectric block 1 between the resonator hole 2*c* and another part of the side surface 1*c* on which the output electrode 4*b* is formed, in a direction parallel to the first and second end surfaces 1*a* and 1*b* or perpendicular to the axial direction of the resonator holes 2*a* to 2*c*, and so as to be close to the first end surface 1*a*, wherein another part of the side surface 1*c* on which the output electrode 4*b* is formed is located apart from the first end surface 1*a* by a predetermined length L (shown in FIG. 1C) which is less than half the longitudinal length of the dielectric coaxial resonators. Further, another connection conductor 7*b* is formed on the inner peripheral surface of the penetrating hole 6*b* so that one end of the connection conductor 7*b* is electrically connected to the output electrode 4*b* and another end of the connection electrode 7*b* is electrically connected to the inner connector 3*c*. Then, the output electrode 4*b* is electrically connected through the connection conductor 7*b* to the inner conductor 3*c*.

As a result, the penetrating hole 6*a* is formed so as to penetrate between the input electrode 4*a* and the inner conductor 3*a*, and the penetrating hole 6*b* is formed so as to penetrate between the input electrode 4*b* and the inner conductor 3*c*.

In the dielectric resonator apparatus having the above-mentioned structure, three comb-line type quarter-wavelength dielectric coaxial resonators are constituted by the inner conductors 3*a* to 3*c*. Generally speaking, the dielectric resonator apparatus is preferably mounted on a printed circuit board (not shown) so that the side surface 1*c* which is the top surface of FIG. 1A is in contact with a top surface of the printed circuit board.

In the dielectric resonator apparatus of the present preferred embodiment, since a pair of input and output electrodes 4*a* and 4*b* is electrically connected through the connection conductors 7*a* and 7*b* to the inner conductors 3*a* and 3*c*, respectively, the dielectric resonator apparatus having external couplings formed by the connection conductors 7*a* and 7*b* can be obtained without any external coupling capacitance Ce.

Figure 4A:
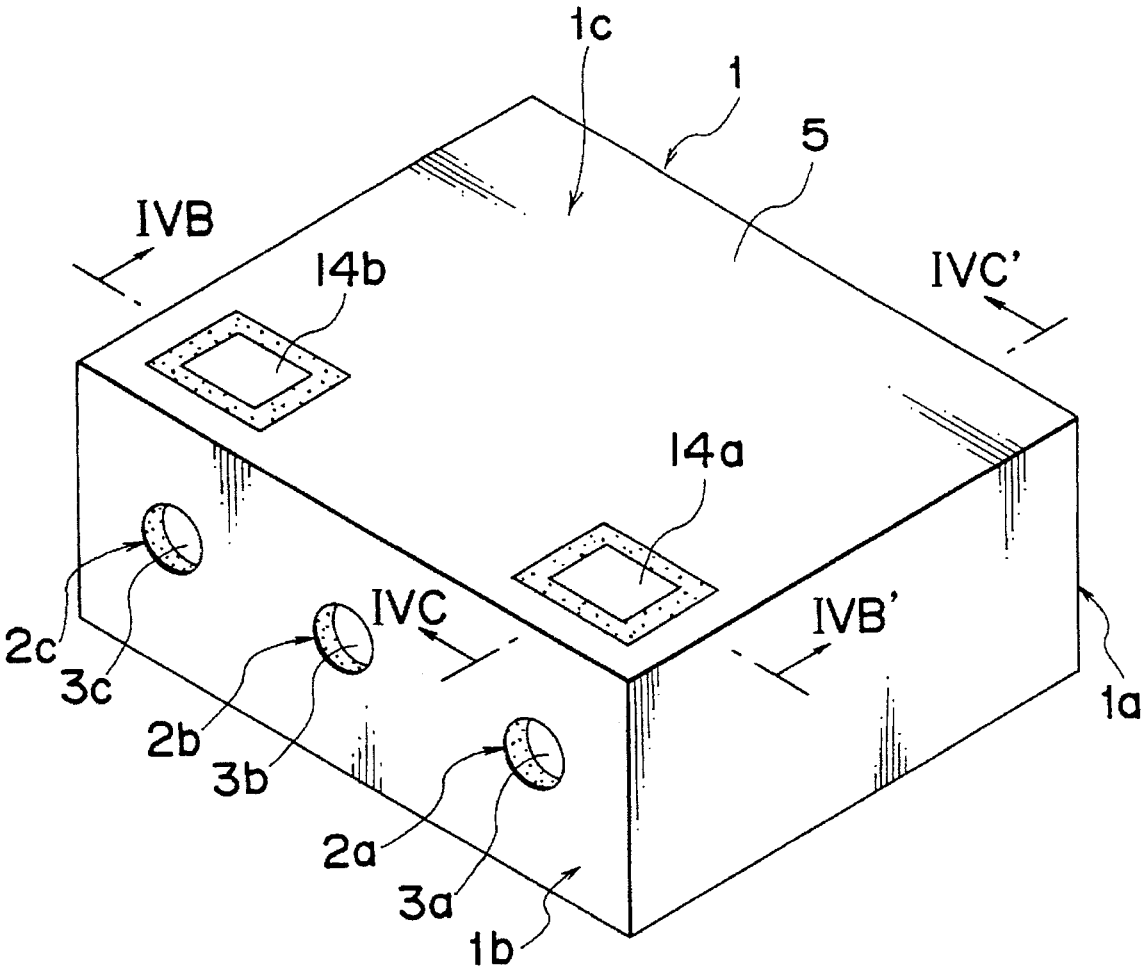
Fig.4A PRIOR ART
FIG. 4A is a perspective view of an appearance of a conventional comb-line type dielectric resonator apparatus.
Figure 4B:
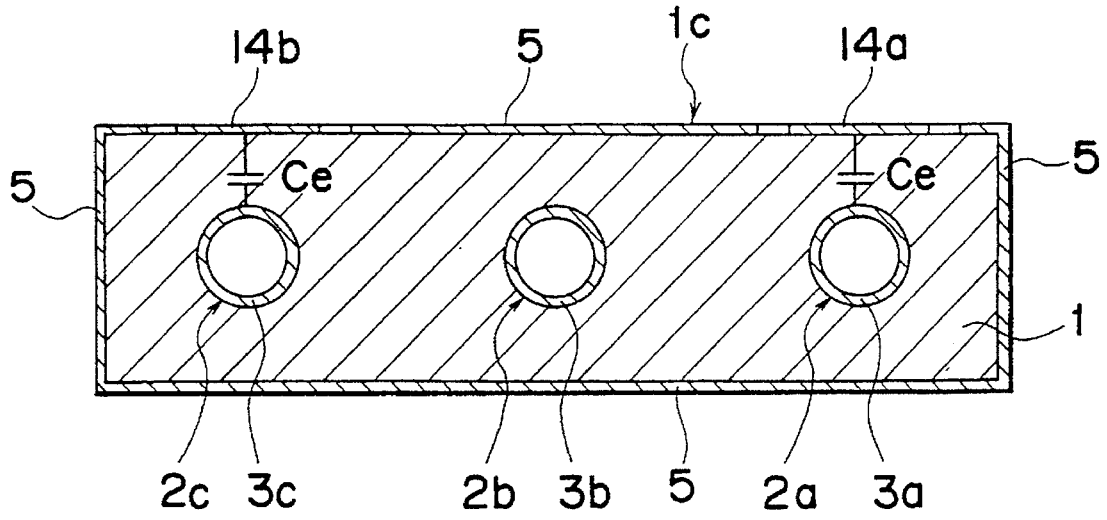
Fig.4B PRIOR ART
FIG. 4B is a cross-sectional view along a line IVB—IVB' of FIG. 4A.
Figure 4C:
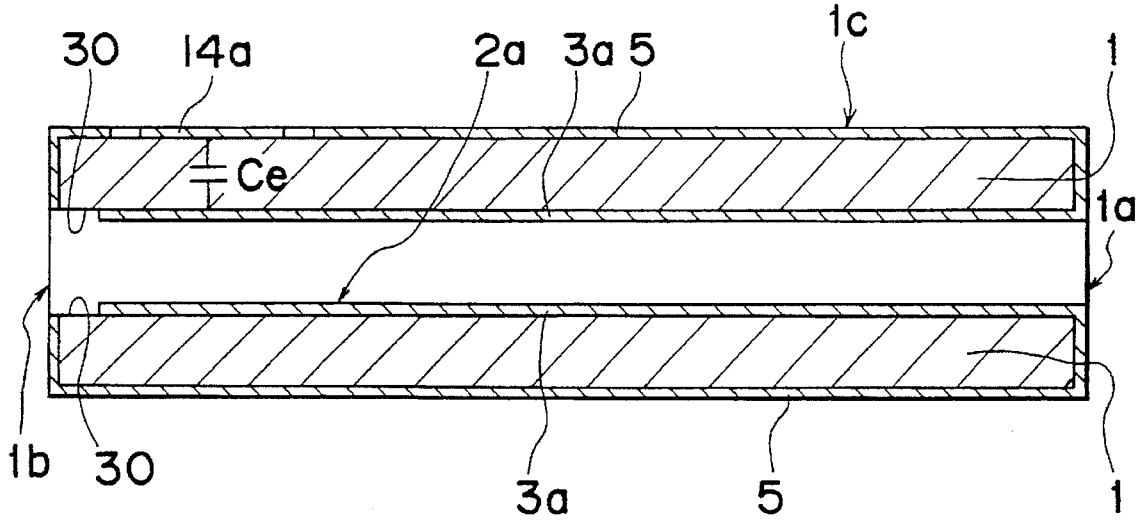
Fig.4C PRIOR ART
FIG. 4C is a cross-sectional view along a line IVC—IVC' of FIG. 4A.

It is to be noted that a pair of input and output electrodes 14*a* and 14*b* is formed on the side surface 1*c* so as to be close to the second end surface 1*b* of the open-circuit surface in the conventional dielectric resonator apparatus shown in FIGS. 4A, 4B and 4C, whereas a pair of input and output electrodes 4*a* and 4*b* is formed on the side surface 1*c* so as to be close to the first end surface 1*a* of the short-circuit surface in the dielectric resonator apparatus of the present preferred embodiment shown in FIGS. 1A, 1B and 1C.

According to such a structure of the dielectric resonator apparatus of the present preferred embodiment, the strengths of the external couplings respectively between a pair of input and output electrodes 4*a* and 4*b* and the dielectric coaxial resonators located at both ends of the three dielectric coaxial resonators can be changed by changing in a direction substantially parallel to the axes of the resonator holes 2*a* to 2*c*, the forming positions of the connection conductors 7*a* and 7*b* for electrically connecting a pair of input and output electrodes 4*a* and 4*b* to the inner conductors 3*a* and 3*c*, respectively, thereby changing the forming positions of the penetrating holes 6*a* and 6*b* in this direction. In other words, the strengths of the external couplings can be changed by increasing the lengths L shown in FIG. 1C between the penetrating hole 6*a* and the first end surface 1*a* of the short-circuit surface and between the penetrating hole 6*b* and the first end surface 1*a* of the short-circuit surface since the electric field strength of each dielectric coaxial resonator on the side of the second end surface 1*b* is stronger than that on the side of the first end surface 1*a*.

Accordingly, desirable optimum external couplings can be obtained without changing the sizes of the dielectric resonator apparatus such as the sizes of the dielectric block 1, the sizes of the resonator holes 2*a* to 2*c* or the like, and without lowering the unloaded Q ($Q_o$) of the dielectric resonator apparatus. In this case, it is not necessary to provide many dielectric resonator apparatuses having different sizes corresponding to various kinds of electric characteristics. Then one dielectric block 1 having a single standard uniform size can be used in common with a plurality of dielectric resonator apparatuses, and the dielectric block 1 can be standardized. This results in a remarkable decrease in both the manufacturing cost and the managing cost.

In the present preferred embodiment, a pair of input and output electrodes 4*a* and 4*b* is formed on the side surface 1*c* of the dielectric block 1 so as to be close to the first end surface 1*a* of the short-circuit surface, however, the present invention is not limited to this. The present invention includes the following second and third preferred embodiments.

SECOND PREFERRED EMBODIMENT

Figure 2A:
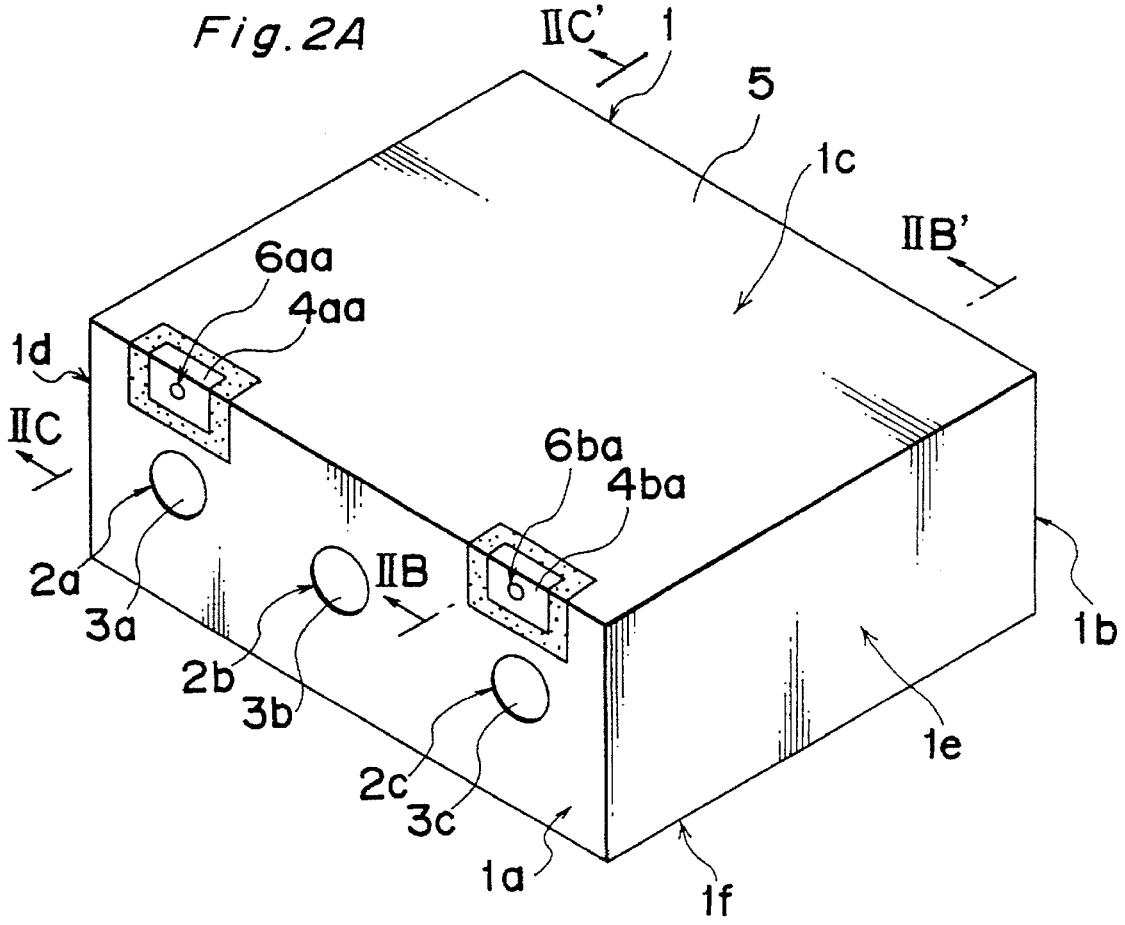
FIG. 2A is a perspective view of an appearance of a comb-line type dielectric resonator apparatus according to a second preferred embodiment of the present invention.
Figure 2B:
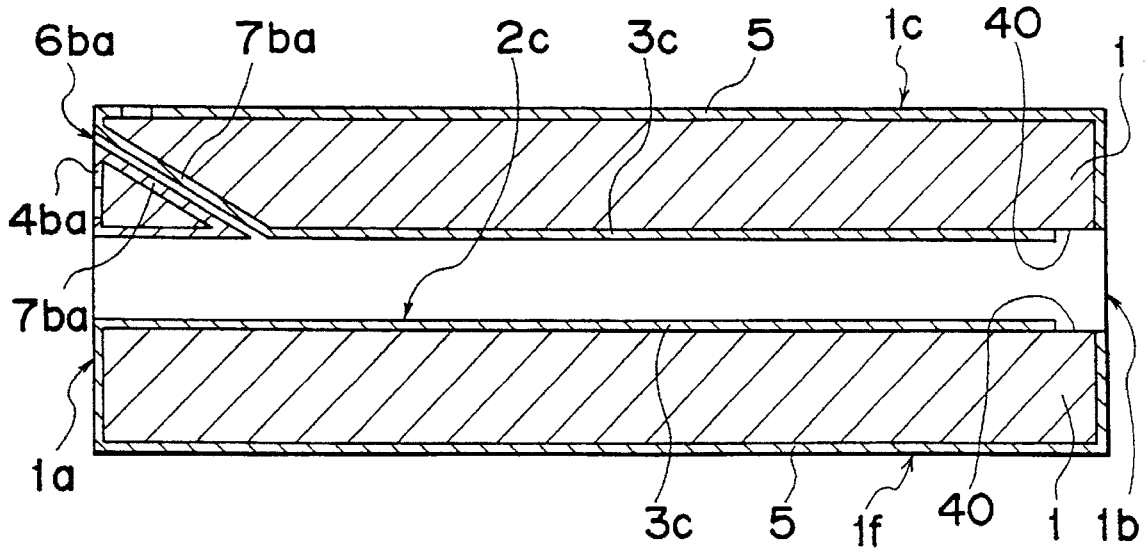
FIG. 2B is a cross-sectional view along a line IIB—IIB' of FIG. 2A.
Figure 2C:
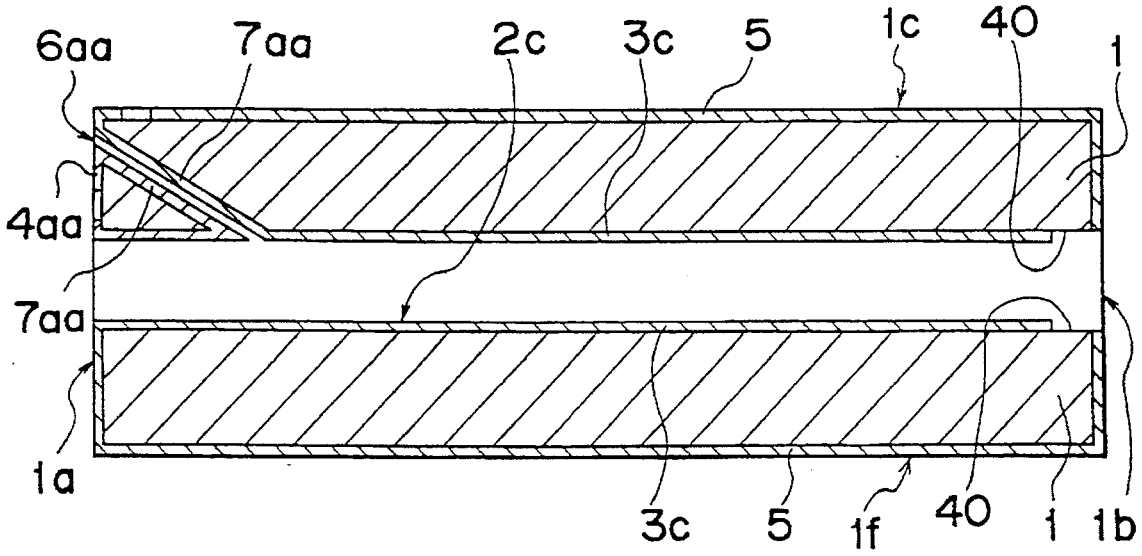
FIG. 2C is a cross-sectional view along a line IIC—IIC' of FIG. 2A.

FIG. 2A is a perspective view of an appearance of a comb-line type dielectric resonator apparatus according to a second preferred embodiment of the present invention, and FIG. 2B is a cross-sectional view along a line IIB—IIB' of FIG. 2A and FIG. 2C is a cross sectional view along a line IIC—IIC' of FIG. 2A. The differences between the first and second preferred embodiments are as follows.

Referring to FIG. 2A, a pair of input and output electrodes 4*aa* and 4*ba* is formed at two areas so as to be electrically insulated from the outer conductor 5 and so as to be close to the inner conductors 3*a* and 3*c*, respectively, wherein each area is located so as to extend from the side surface 1*c* to the first end surface 1*a* of the short-circuit surface. In the present preferred embodiment, penetrating holes 6*aa* and 6*ba* are formed in a direction inclined from the axial direction of each of the resonator holes 2*a* to 2*c* so as to penetrate the dielectric block 1 between the first end surface 1*a* and each of the inner conductors 3*a* and 3*c*, respectively, and then, referring now to FIGS. 2B and 2C, connection conductors 7*aa* and 7*ba* are formed on the inner peripheral surfaces of the penetrating holes 6*aa* and 6*ba*, respectively. Then the input electrode 4*aa* is electrically connected through the connection conductor 7*aa* to the inner conductor 3*a*, and the output electrode 4*ba* is electrically connected through the connection conductor 7*ba* to the inner conductor 3*c*.

THIRD PREFERRED EMBODIMENT

Figure 3:
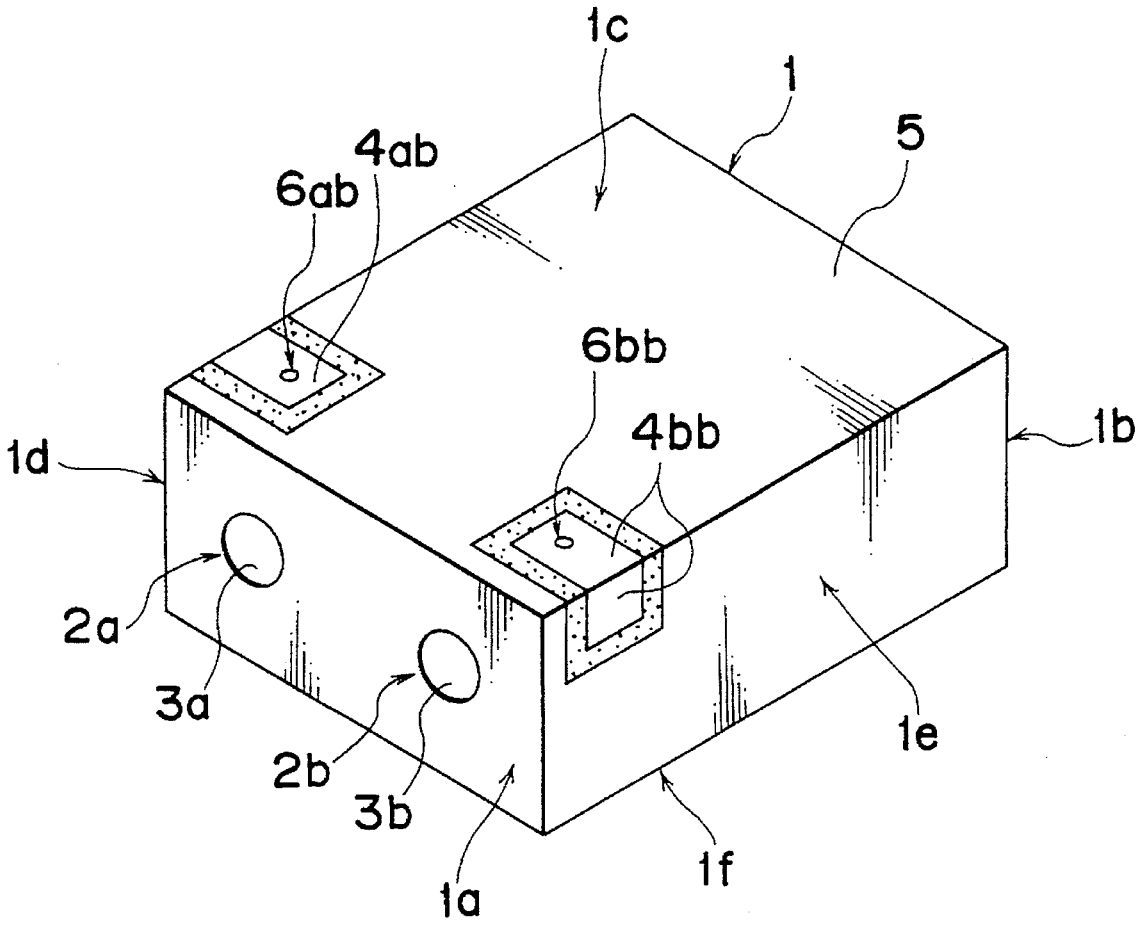
FIG. 3 is a perspective view of an appearance of a comb-line type dielectric resonator apparatus according to a third preferred embodiment of the present invention.

FIG. 3 is a perspective view of an appearance of a comb-line type dielectric resonator apparatus comprising two dielectric coaxial resonators, according to a third preferred embodiment of the present invention. The differences between the first and third preferred embodiments are as follows.

Referring to FIG. 3, a pair of input and output electrodes 4*ab* and 4*bb* is formed at two areas so as to be electrically insulated from the outer conductor 5 and so as to be close to the inner conductors 3*a* and 3*b*, respectively, wherein one area is located so as to extend from the side surface 1*c* to the side surface 1*d*, and another area is located so as to extend from the side surface 1*c* to the side surface 1*e*. In the present preferred embodiment, penetrating holes 6*ab* and 6*bb* are formed so as to penetrate the dielectric block 1 between the side surface 1*c* and each of the inner conductors 3*a* and 3*c*, respectively, and then connection conductors (not shown) are formed on the inner peripheral surfaces of the penetrating holes 6*ab* and 6*bb*, respectively. Then the input electrode 4*ab* is electrically connected through the connection conductor to the inner conductor 3*a*, and the output electrode 4*bb* is electrically connected through the connection conductor to the inner conductor 3*b*.

OTHER PREFERRED EMBODIMENTS

In the above-mentioned first and second preferred embodiments, the dielectric resonator apparatus comprising the three dielectric coaxial resonators is described. In the above-mentioned third preferred embodiment, the dielectric resonator apparatus comprising the two dielectric coaxial resonators is described. However, the present invention is not limited to this. The dielectric resonator apparatus may comprise one, four, or more than four dielectric coaxial resonators.

In the above-mentioned preferred embodiments, the circular cylindrical resonator holes 2*a* to 2*c* are formed in the dielectric block 1, however, the present invention is not limited to this. Resonator holes each having the other shape such as a rectangular cylindrical shape, a hexagonal prism, or the like may be formed in the dielectric block 1.

In the above-mentioned preferred embodiments, the gap 40 is formed in the vicinity of the second end surface 1*b* of the open-circuit surface, however, the present invention is not limited to this. The gap 40 may be formed in each of the resonator holes 2*a* to 2*c* so as to be apart from the second end surface 1*b* of the open-circuit surface by a predetermined distance.

A gap for electrically insulating each of the inner conductors 3*a* to 3*c* from the outer conductor 5 may be formed by forming a gap, where the outer conductor 5 is not formed, in the vicinity of the openings of the resonator holes 2*a* to 2*c* which are located on the second end surface 1*b*. This gap may be formed on the whole second surface 1*b*. In other words, the outer conductor 5 is not formed on the second surface 1*b*.

In each of the above-mentioned preferred embodiments, the comb-line type dielectric resonator apparatus comprising a plurality of quarter-wavelength dielectric coaxial resonators is described. However, the present invention is not limited to this. The present invention can apply to a comb-line type dielectric resonator apparatus comprising a plurality of half-wavelength dielectric coaxial resonators, an interdigital type dielectric resonator apparatus comprising a plurality of quarter-wavelength dielectric coaxial resonators, and an interdigital type dielectric resonator apparatus comprising a plurality of half-wavelength dielectric coaxial resonators- In the interdigital type dielectric resonator apparatus comprising a plurality of dielectric coaxial resonators, the gaps 40 are formed alternately in the vicinity of the first and second end surfaces 1*a* and 1*b* in the resonator holes 2*a* to 2*c*. For example, in the first preferred embodiment shown in FIGS. 1A, 1B and 1C, the gap 40 of the inner conductor 3*a* is formed in the vicinity of the second end surface 1*b*, the gap 40 of the inner conductor 3*b* is formed in the vicinity of the first end surface 1*a*, and the gap 40 of the inner conductor 3*c* is formed in the vicinity of the second end surface 1*b*.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A dielectric resonator apparatus comprising:

a dielectric block of a dielectric material having first and second end surfaces, and a plurality of side surfaces located between the first end surface and the second end surface;

at least one cylindrical resonator hole disposed so as to penetrate an inner portion of said dielectric block, said at least one resonator hole respectively having an opening on the first end surface of said dielectric block and another opening on the second end surface of said dielectric block;

an outer conductor disposed on at least the first end surface and said plurality of side surfaces of said dielectric block;

at least one inner conductor respectively disposed on an inner portion of said corresponding at least one resonator hole, said respective at least one inner conductor having one end thereof located adjacent the first end surface of said dielectric block is electrically connected to said outer conductor and another end thereof located adjacent the second end surface of said dielectric block is electrically insulated from said outer conductor, thereby constituting at least one dielectric coaxial resonator;

a pair of input and output electrodes respectively disposed on at least one predetermined side surface of said dielectric block so as to be electrically insulated from said outer conductor and so as to be close to said one end of said inner conductor of an associated one of said at least one resonator, said respective electrode being located adjacent the first end surface of said dielectric block;

two penetrating holes respectively disposed so as to penetrate an inner portion of said dielectric block between said pair of input and output electrodes and said inner conductor of the corresponding ones of said at least one resonator; and two connection conductors for electrically connecting said pair of input and output electrodes to said inner conductor of the corresponding ones of said at least one resonator, said two connection conductors being respectively disposed on inner portions of said corresponding penetrating holes; wherein said pair of input and output electrodes are respectively disposed so as to extend from the predetermined side surface of said dielectric block to an adjacent said side surface of said dielectric block.

2. The apparatus as claimed in claim 1, wherein said two penetrating holes are respectively disposed so as to penetrate the inner portion of said dielectric block between the predetermined side surface of said dielectric block to said inner conductor of the corresponding ones of said at least one resonator.

3. A dielectric resonator apparatus comprising:

a dielectric block of a dielectric material having first and second end surfaces, and a plurality of side surfaces located between the first end surface and the second end surface;

at least one cylindrical resonator hole disposed so as to penetrate an inner portion of said dielectric block, said at least one resonator hole respectively having fan opening on the first end surface of said dielectric block and another opening on the second end surface of said dielectric block;

an outer conductor disposed on at least the first end surface and said plurality of side surfaces of said dielectric block;

at least one inner conductor respectively disposed on an inner portion of said corresponding at least one resonator hole, said respective at least one inner conductor having one end thereof located adjacent the first end surface of said dielectric block is electrically connected to said outer conductor and another end thereof located adjacent the second end surface of said dielectric block is electrically insulated from said outer conductor, thereby constituting at least one dielectric coaxial resonator;

a pair of input and output electrodes respectively disposed on at least one predetermined side surface of said dielectric block so as to be electrically insulated from said outer conductor and so as to be close to said one end of said inner conductor of an associated one of said at least one resonator, said respective electrode being located adjacent the first end surface of said dielectric block;

two penetrating holes respectively disposed so as to penetrate an inner portion of said dielectric block between said pair of input and output electrodes and said inner conductor of the corresponding ones of said at least one resonator; and two connection conductors for electrically connecting said pair of input and output electrodes to said inner conductor of the corresponding ones of said at least one resonator, said two connection conductors being respectively disposed on inner portions of said corresponding penetrating holes; wherein said pair of input and output electrodes is disposed so as to respectively extend from the predetermined side surface of said dielectric block to the first end surface thereof.

4. The apparatus as claimed in claim 3, wherein said at least one resonator comprises a respective plurality of resonator holes, thereby comprising a plurality of dielectric coaxial resonators including a first and a last resonator, said pair of input and output electrodes are disposed respectively close to corresponding ones of said two inner conductors located in said first and last resonators, respectively, said two penetrating holes are disposed so as to penetrate the inner portion of said dielectric block between said pair of input and output electrodes and said two inner conductors of said first and last resonators, respectively, and said two connection conductors electrically connect said pair of input and output electrodes to said two inner conductors of said first and last resonators, respectively.

5. The apparatus as claimed in claim 4, wherein said pair of input and output electrodes are disposed so as to respectively extend from the predetermined side surface of said dielectric block to an adjacent said side surface of said dielectric block.

6. The apparatus as claimed in claim 5, wherein said two penetrating holes are disposed so as to penetrate the inner portion of said dielectric block, from the predetermined side surface of said dielectric block to said two inner conductors located in said first and last resonators.

7. The apparatus as claimed in claim 4, wherein said pair of input and output electrodes is disposed so as to respectively extend from the predetermined side surface of said dielectric block to the first end surface thereof.

8. The apparatus as claimed in claim 7, wherein said two penetrating holes are disposed so as to penetrate the inner portion of said dielectric block between said first end surface of said dielectric block to said two inner conductors located in said first and last resonators.

9. The apparatus as claimed in claim 3, wherein said two penetrating holes are respectively disposed so as to penetrate the inner portion of said dielectric block between said first end surface of said dielectric block to said inner conductor of the corresponding ones of said at least one resonator.

10. A dielectric resonator apparatus comprising:

a dielectric block of a dielectric material having first and second end surfaces, and a plurality of side surfaces located between the first end surface and the second end surface;

at least one cylindrical resonator hole disposed so as to penetrate an inner portion of said dielectric block, said at least one resonator hole respectively having an opening on the first end surface of said dielectric block and another opening on the second end surface of said dielectric block;

an outer conductor disposed on at least the first end surface and said plurality of side surfaces of said dielectric block;

at least one inner conductor respectively disposed on an inner portion of said corresponding at least one resonator hole, said respective at least one inner conductor having one end thereof located adjacent the first end surface of said dielectric block is electrically connected to said outer conductor and another end thereof located adjacent the second end surface of said dielectric block is electrically insulated from said outer conductor, thereby constituting at least one dielectric coaxial resonator;

a pair of input and output electrodes respectively disposed on at least one predetermined side surface of said dielectric block so as to be electrically insulated from said outer conductor and so as to be close to said one end of said inner conductor of an associated one of said at least one resonator, said respective electrode being located adjacent the first end surface of said dielectric block;

two penetrating holes respectively disposed so as to penetrate an inner portion of said dielectric block between said pair of input and output electrodes and said inner conductor of the corresponding ones of said at least one resonator; and two connection conductors for electrically connecting said pair of input and output electrodes to said inner conductor of the corresponding ones of said at least one resonator, said two connection conductors being respectively disposed on inner portions of said corresponding penetrating holes; wherein said at least one resonator comprises a plurality of resonator holes, thereby comprising a plurality of dielectric coaxial resonators including a first and last resonator, said pair of input and output electrodes are respectively disposed close to corresponding ones of said two inner conductors located respectively in said first and last resonators, said two penetrating holes are disposed so as to penetrate the inner portion of said dielectric block between said pair of input and output electrodes and said two inner conductors of said first and last resonators, respectively;

said two connection conductors electrically connect said pair of input and output electrodes to said two inner conductors of said first and last resonators, respectively; and said pair of input and output electrodes are respectively disposed so as to respectively extend from the predetermined side surface of said dielectric block to an adjacent said side surfaces of said dielectric block.

11. The apparatus as claimed in claim 10, wherein said two penetrating holes are disposed respectively so as to penetrate the inner portion of said dielectric block, from the predetermined side surface of said dielectric block to said two inner conductors located in said first and last resonators.

12. A dielectric resonator apparatus comprising:

a dielectric block of a dielectric material having first and second end surfaces, and a plurality of side surfaces located between the first end surface and the second end surface;

at least one cylindrical resonator hole disposed so as to penetrate an inner portion of said dielectric block, said at least one resonator hole respectively having an opening on the first end surface of said dielectric block and another opening on the second end surface of said dielectric block;

an outer conductor disposed on at least the first end surface and said plurality of side surfaces of said dielectric block;

at least one inner conductor respectively disposed on an inner portion of said corresponding at least one resonator hole, said respective at least one inner conductor having one end thereof located adjacent the first end surface of said dielectric block is electrically connected to said outer conductor and another end thereof located adjacent the second end surface of said dielectric block is electrically insulated from said outer conductor, thereby constituting at least one dielectric coaxial resonator;

a pair of input and output electrodes respectively disposed on at least one predetermined side surface of said dielectric block so as to be electrically insulated from said outer conductor and so as to be close to said one end of said inner conductor of an associated one of said at least one resonator, said respective electrode being located adjacent the first end surface of said dielectric block;

two penetrating holes respectively disposed so as to penetrate an inner portion of said dielectric block between said pair of input and output electrodes and said inner conductor of the corresponding ones of said at least one resonator; and two connection conductors for electrically connecting said pair of input and output electrodes to said inner conductor of the corresponding ones of said at least one resonator, said two connection conductors being respectively disposed on inner portions of said corresponding penetrating holes; wherein said at least one resonator comprises a plurality of resonator holes, thereby comprising a plurality of dielectric coaxial resonators including a first and a last resonator, said pair of input and output electrodes are disposed respectively close to corresponding ones of said two inner conductors located in said first and last resonators, respectively, said two penetrating holes are disposed so as to penetrate the inner portion of said dielectric block between said pair of input and output electrodes and said two inner conductors of said first and last resonators, respectively, and said two connection conductors electrically connect said pair of input and output electrodes to said two inner conductors of said first and last resonators, respectively; wherein said pair of input and output electrodes is disposed so as to respectively extend from the predetermined side surface of said dielectric block to the first end surface thereof.

13. The apparatus as claimed in claim 12, wherein said two penetrating holes are disposed so as to penetrate the inner portion of said dielectric block, from said first end surface of said dielectric block to said two inner conductors located in said first and last resonators.

* * * * *